US010961076B2

(12) United States Patent
Gordon et al.

(10) Patent No.: US 10,961,076 B2
(45) Date of Patent: Mar. 30, 2021

(54) METHOD AND APPARATUS FOR ALIGNING SHEET MATERIAL

(71) Applicant: GERBER TECHNOLOGY LLC, Tolland, CT (US)

(72) Inventors: Thomas A. Gordon, Glastonbury, CT (US); Harrison Roberts, Willington, CT (US); David A. Simm, Westfield, MA (US); Ken Szarek, Tolland, CT (US)

(73) Assignee: Gerber Technology LLC, Tolland, CT (US)

( * ) Notice: Subject to any disclaimer, the term of this patent is extended or adjusted under 35 U.S.C. 154(b) by 0 days.

(21) Appl. No.: 16/197,932

(22) Filed: Nov. 21, 2018

(65) Prior Publication Data

US 2019/0152736 A1 May 23, 2019

Related U.S. Application Data

(60) Provisional application No. 62/589,771, filed on Nov. 22, 2017.

(51) Int. Cl.
*B65H 43/08* (2006.01)
*B65H 35/00* (2006.01)
(Continued)

(52) U.S. Cl.
CPC ..... *B65H 43/08* (2013.01); *B26D 5/007* (2013.01); *B26D 7/015* (2013.01); *B65H 35/008* (2013.01); *B65H 2701/1315* (2013.01)

(58) Field of Classification Search
CPC ..... B65H 43/08; B65H 35/008; B65H 2701/1315; B26D 5/007; B26D 7/015
See application file for complete search history.

(56) References Cited

U.S. PATENT DOCUMENTS 4,296,405 A * 10/1981 Rich ..... A24C 1/04 131/105
4,907,169 A 3/1990 Lovoi
(Continued)

FOREIGN PATENT DOCUMENTS

CN 204057436 U 12/2014
CN 206406106 U 8/2017
(Continued)

OTHER PUBLICATIONS

Banner Engineering Corp., QC50 Series True Color Sensor Data Sheet, "Compact, Self-Contained, Three-Output Color-Differentiating Sensor", Feb. 27, 2017. (7 pgs.).
(Continued)

*Primary Examiner* — Omar Flores Sanchez
(74) *Attorney, Agent, or Firm* — Valeriya Svystun; Day Pitney LLP

(57) ABSTRACT

An apparatus and method for determining sheet material edges on a surface including a sensor configured to detect an outer edge and a usable edge of the sheet material and a controller in communication with the sensor. The sensor comprises a first color optical sensor producing a first signal representing a first physical attribute of the sheet material and a second color optical sensor producing a second signal representing a second physical attribute of the sheet material. The controller comprises a processor, a memory, and a communications adapter, controls dispensing and spreading of the sheet material for detection by the sensor, and signals to a user a presence of the usable edge in the sheet material upon detection by the sensor.

17 Claims, 7 Drawing Sheets

(51) Int. Cl.
*B26D 5/00* (2006.01)
*B26D 7/01* (2006.01)

(56) References Cited

U.S. PATENT DOCUMENTS

| | | | | |
|---|---|---|---|---|
| 5,078,666 | A * | 1/1992 | Porret | B26D 5/007 493/1 |
| 5,586,479 | A * | 12/1996 | Roy | B26D 7/015 346/24 |
| 5,791,215 | A | 8/1998 | Morrison et al. | |
| 6,889,028 | B1 | 5/2005 | Hunold et al. | |
| 8,251,882 | B2 * | 8/2012 | Decker | B65H 9/14 493/419 |
| 8,323,162 | B2 * | 12/2012 | Decker | B65H 9/14 493/8 |
| 2011/0156341 | A1 * | 6/2011 | Fujita | B65H 7/10 271/10.11 |
| 2019/0075206 | A1 * | 3/2019 | Tanigawa | H04N 1/0066 |
| 2019/0112146 | A1 * | 4/2019 | Fujiki | B65H 43/08 |

FOREIGN PATENT DOCUMENTS

| | | | |
|---|---|---|---|
| EP | 0606347 | B1 | 8/1998 |
| KR | 20100076235 | A | 7/2010 |

OTHER PUBLICATIONS

Keyence America, LR-W500 Data Sheet, Nov. 18, 2017. (4 pgs.)
International Search Report and the Written Opinion of the International Search Authority issued in corresponding International application No. PCT/US2018/062234, Mar. 21, 2019.
Bond et al., "Gerber Technology—an overview | ScienceDirect Topics", Science Direct, Dec. 31, 2014; XP055560141, Retrieved from the Internet: URL: <https://www.sciencedirect.com/topics/engineering/gerber-technology> Retrieved on Feb. 21, 2019, pp. 1-11.
Panasonic, Color Detection Fiber Sensor brochure, FZ-10 series, pp. 939-944, Nov. 27, 2017.
Panasonic, Digital Mark Sensor, Amplifier Built-in, LX-100 Series brochure, pp. 899-908. Nov. 27, 2017.
Gerber Technology, XLs50 Spreader brochure, Form No. 09032015, "Get Exceptional Quality and Performance in a Tension-Free Spreading System at an Affordable Price", Sep. 2015. (2 pgs.).
Gerber Technology, XLs125 Spreader brochure, Form No. 06202017, "Get Exceptional Quality and Performance in a Tension-Free Spreading System at an Affordable Price", Jun. 2017. (2 pgs.).

* cited by examiner

METHOD AND APPARATUS FOR ALIGNING SHEET MATERIAL

CROSS-REFERENCE TO RELATED APPLICATIONS

This patent application claims the benefit of priority to U.S. Provisional Patent Application Ser. No. 62/589,771, filed on Nov. 22, 2017. The content of the referenced provisional patent application is incorporated herein by reference in its entirety for any purpose whatsoever.

BACKGROUND OF THE INVENTION

1. Field of the Invention

The invention disclosed herein relates to spreading machines, cutting tables and other devices that manipulate sheet material, and in particular to systems for detecting an edge or border of the sheet material.

2. Description of the Related Art

Sheet material such as cloth, laminates and the like is used in a variety of products. Included are garments, upholstery and many other products. High production volume necessitates efficient work practices with sophisticated equipment. Examples of equipment useful for preparing sheet material in the manufacturing process include cutting tables and spreaders. Generally, a spreader will spread the sheet material for subsequent cutting with the cutting table. The exceedingly competitive nature of such enterprises requires manufacturers to work quickly and make as much use as possible of the sheet material consumed.

Traditionally, when material is spread with an automatic spreading machine, the material is automatically aligned in the direction of the spread by an actuator acting in response to a sensor that locates one edge of the material. This edge detection is accomplished using two reflective sensors. As the material feeds from the roll, the spreader moves the roll in its cradle, from side to side to keep an inner reflective sensor blocked (so the sensor cannot see the reflection) and an outer sensor reflecting (nothing is interfering with the reflection). If the inner sensor sees a reflection, the cradle moves the material laterally toward the outer sensor. If the outer sensor is blocked, the cradle moves the material laterally toward the inner sensor.

In laminates, surface printed materials and some woven materials, the edge of the fabric is not useable in final products. In the case of some laminates, for example, a process of bonding a lower foam layer to a surface layer result in layered material with a variable edge. Refer, for example, to FIGS. 1 and 2 which show typical laminates of sheet material 10 with a variable edge.

In some embodiments, fabric from a roll is processed through a trimming step to make edges uniform. Trimming requires a separate process which consumes time and results in some waste. As a result, trimming is not always done. In order to compensate for this unusable portion of material when using untrimmed material, the usable edge may be manually aligned by an operator. Manual alignment may include aligning a top layer of sheet material 10 to at least one lower layer of sheet material 10 before a stack of layers of sheet material 10 are cut. Refer, for example, to FIG. 3, where sheet material 10 has been provided in a stack of layers 30. The stack of layers 30 has been arranged by the prior art technique of manual alignment.

Both of these options result in waste of material. Manual alignment is a time consuming task and can cause additional wrinkles to be introduced to the spread material while offset the cutting origin wastes material. In addition, it is difficult for the operator to accurately align multiple layers of the material by eye, especially over long spreads of fabric, because improving one alignment may adversely affect a previous alignment. Likewise some other materials (as shown in FIG. 4) may not have a consistent usable edge.

Examples of sheet material 10 are depicted in FIG. 4. In FIG. 4, each of the examples, the sheet material 10 includes a usable width 42 and excess material 41. In the examples shown, the sheet material 10 is woven material and the excess material is selvage of the sheet material 10. A usable edge separates the selvage from the usable material.

Thus, what are needed are methods and apparatus to provide a material spreader with identification of usable edges within sheets of material.

SUMMARY OF THE INVENTION

In one embodiment, a spreader apparatus is shown and described herein. In another embodiment, a method for operating a spreader apparatus is shown and described herein. In a further embodiment, a control system for controlling a spreader apparatus as shown and described herein.

BRIEF DESCRIPTION OF THE DRAWINGS

The features and advantages of the invention are apparent from the following description taken in conjunction with the accompanying drawings in which.

DETAILED DESCRIPTION OF THE INVENTION

Disclosed herein are methods and apparatus for detecting a usable edge of sheet material. Application of the methods and apparatus results in positioning of the usable edge of the sheet material for fabrication processes.

Generally, a material spreading machine, or "spreader" is a machine useful for spreading sheet material. The sheet material may be spread to provide for subsequent cutting of the material to a desired size. In embodiments disclosed herein, the material spreading machine is used for production of consumer goods such as garments, upholstery for residential, commercial and/or automotive furnishings and for other similar products.

Although embodiments disclosed herein are presented in terms a material spreading machine, such embodiments are merely illustrative and are not limiting of the teachings herein. Generally, the techniques for edge alignment presented herein may be useful in cutters and spreaders, and any other type of material processing machinery that makes use of a clean reference edge that differs from the physical edge of the material.

Generally, the term "sheet material" as disclosed herein relates thicknesses of flat material selected for processing. The sheet material may be provided as separate sheets of material, in roll form, in continuous form such as those materials that are longer than the workstation described herein, or in any other manner deemed suitable.

Prior to discussing the material spreading machine with more detail, aspects of sheet material are introduced.

Figure 1:
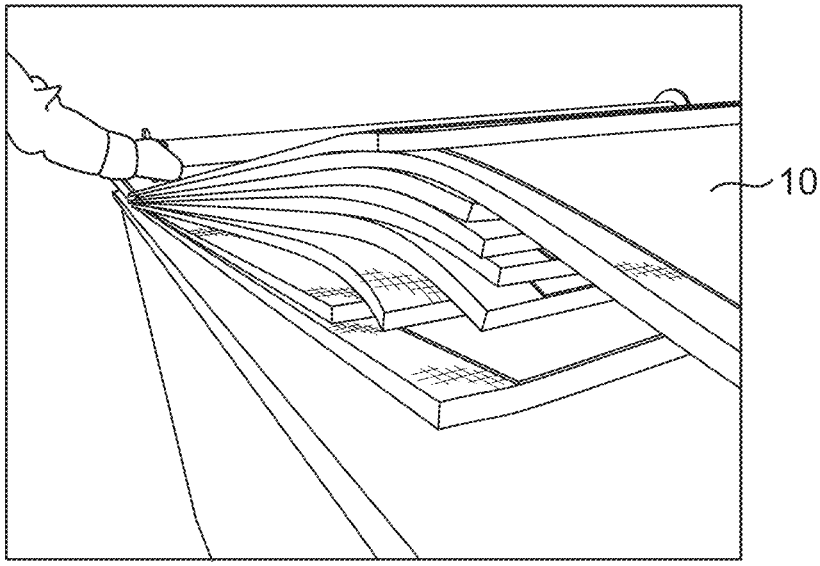
FIG. 1 through FIG. 4 are depictions of material that exhibit an outer edge and a usable edge.
Figure 2:
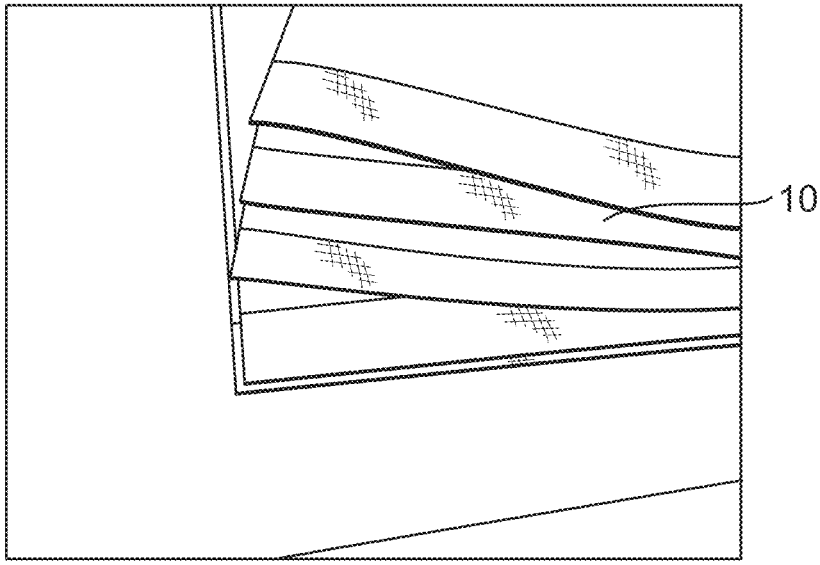
Figure 3:
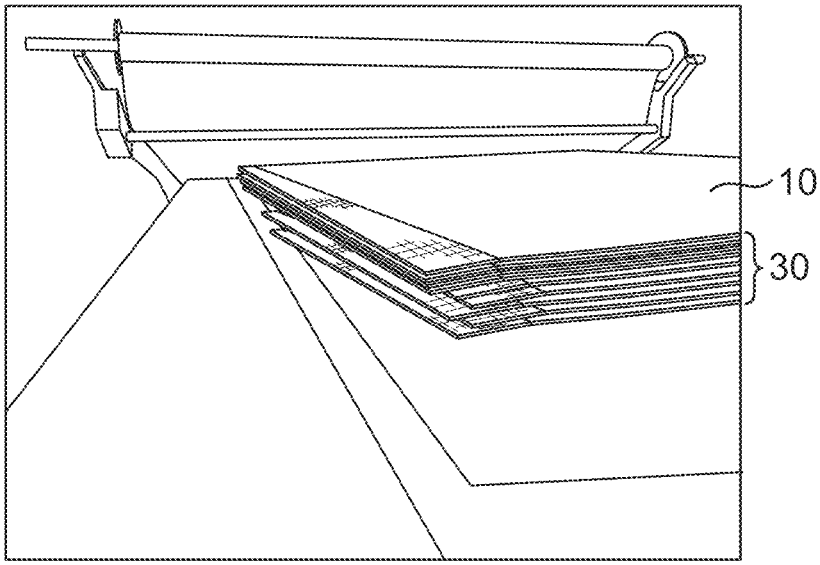
FIG. 3 (PRIOR ART)
Figure 4:
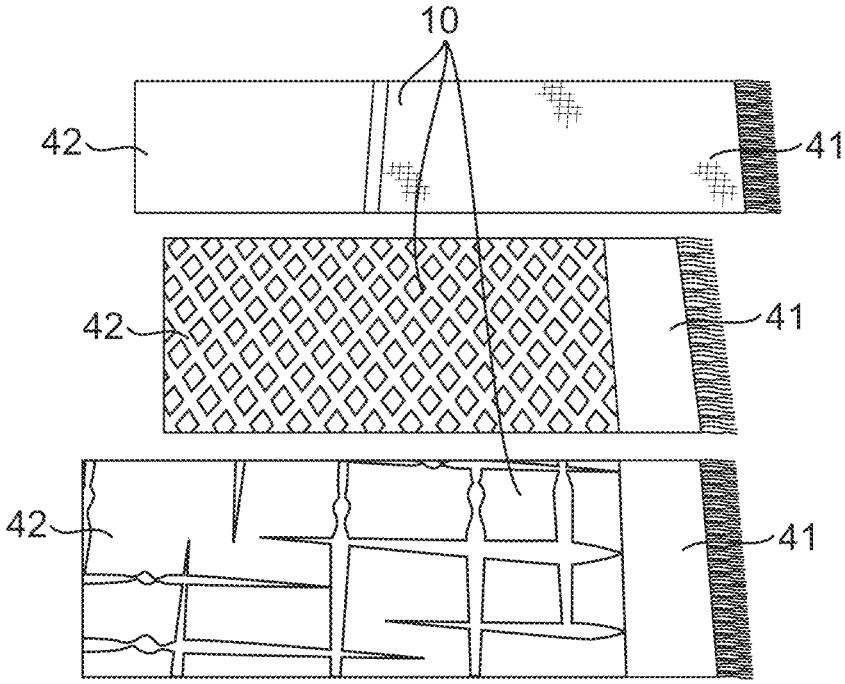
Figure 5:
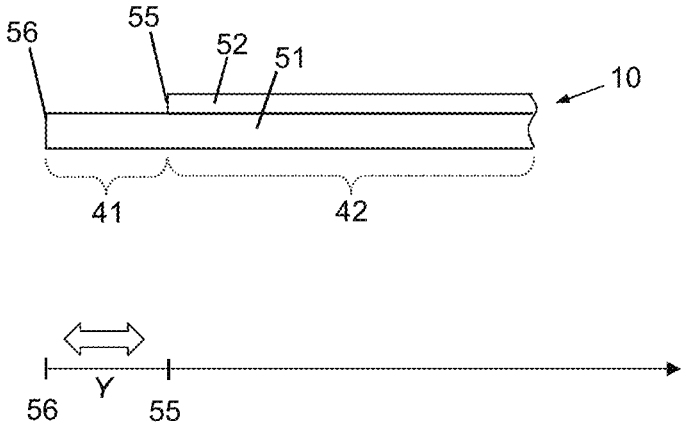
FIG. 5 is a schematic diagram useful for introducing terms related to sheet material.

Referring to FIG. 5, a cross section of a layer of sheet material 10 is illustrated. The cross-section provides a view along a width, W, of the sheet material 10 (shown in the Y-direction). In this illustration, the sheet material 10 depicted in FIG. 5 includes two-layers. Examples of sheet material 10 with two-layers include woven or non-woven materials having a coating, such as vinyl disposed thereon.

In this example, the first layer 51 is a base layer, such as the woven or non-woven material of the foregoing example. Disposed on the first layer 51 is a second layer 52, such as the vinyl coating of the foregoing example. The usable width 42 is defined by the portion of sheet material 10 where the first layer 51 is host to or covered by the second layer 52. A usable edge 55 exists at an edge of the usable width 42. A strip of the excess material 41 exists beyond the usable width 42. An outer edge 56 exists at the extent of the width of the sheet material 10.

Generally, the excess material 41 is a portion of the sheet material 10 that unusable in a finished product. The excess material 41 may be the result of fabrication processes for the sheet material 10. In one example, the excess material 41 is a narrow width of material grasped between rollers while the second layer 52 is applied to the first layer 51 during fabrication.

In another example, the sheet material 10 is a woven material. The woven material is not layered, and therefore of a single layer. The usable width 42 includes a weave, and may include, for example, a pattern in the weave. The excess material 41 includes selvage, or the self-finished edge of the weave. Generally, the selvage keeps the fabric from unraveling or fraying. Most sheet materials have a selvage edge which has an incomplete weave and is therefore not useable in a finished product. Typically, the selvage area has a density lower than the primary useable width of the sheet material 10.

Figure 6:
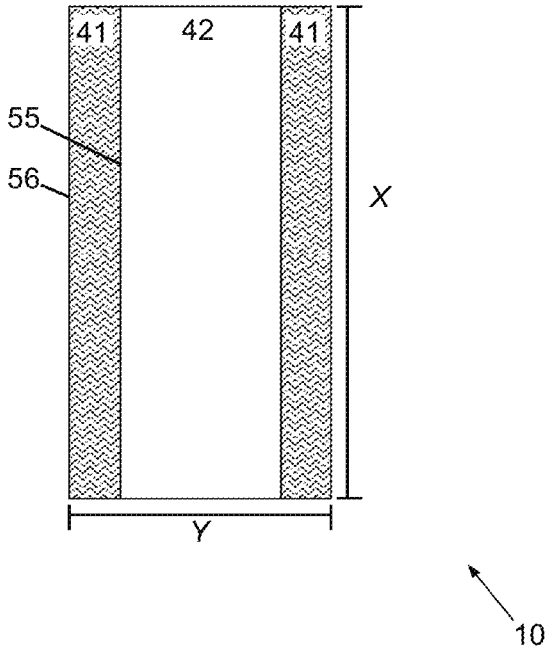
FIG. 6 is a schematic diagram depicting a work station with a material spreading machine.

FIG. 6 depicts the sheet material 10 from the top. In this illustration, it may be seen that a length, L, of the sheet material extends in a X-direction.

The sheet material 10 depicted in FIG. 5 and FIG. 6 is a two-layer sheet of material 10. In some other embodiments, the sheet material 10 may be a single layer, or include another number of layers.

As one might imagine, the width of the excess material 41 and therefore the relationship of the usable edge 55 to the outer edge 56 may vary. Predictably, manual alignment of sheet material 10 having an appreciable length, L, (in the X-direction) can be very cumbersome and only reasonably achievable with two people and/or specialized anchoring or clamping if a stack of layers 30 is desired. Accordingly, methods and apparatus for alignment of the usable edge 55 on a spreading machine are presented herein.

Figure 7:
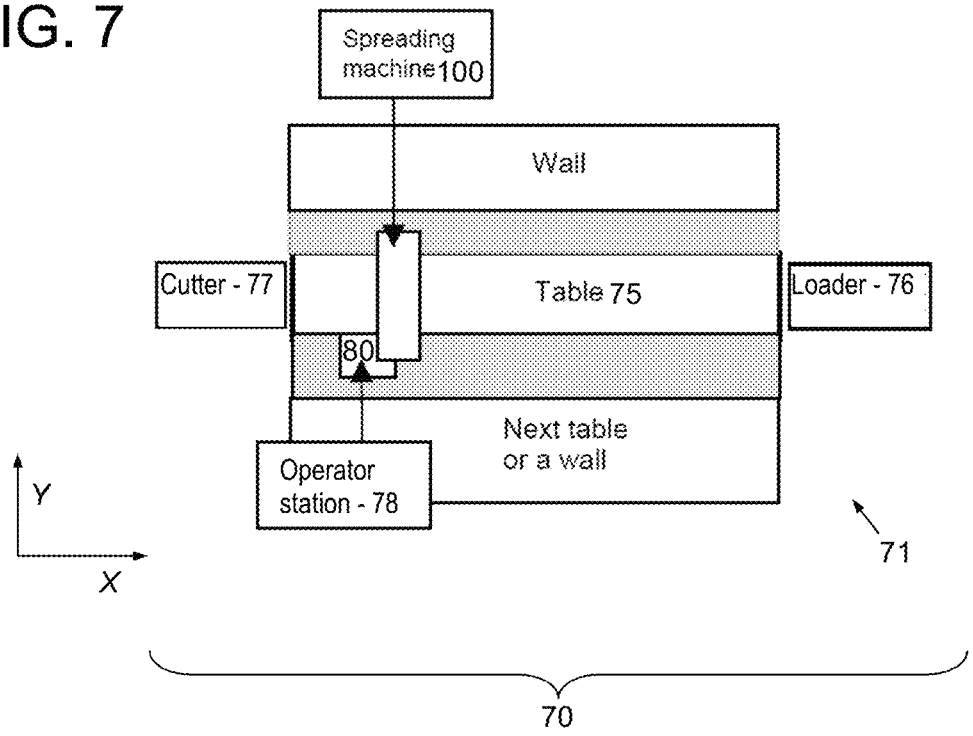
FIG. 7 is a schematic diagram depicting relationships of components of the material spreading machine of FIG. 6.

Refer to FIG. 7 where aspects of an example of a system for aligning and spreading sheet material is depicted. In this example, the system 70 includes a workstation 71. The workstation 71 includes a spreading machine 100. Generally, the workstation 71 includes a loader 76 for loading the sheet material 10 and a cutter 77 for cutting the sheet material 10. A table 75 may be included to provide a surface for loading and spreading sheet material 10 that is then fed to the cutter 77. Operation of the workstation 71 may be controlled by an operator at a controller 80.

Figure 8:
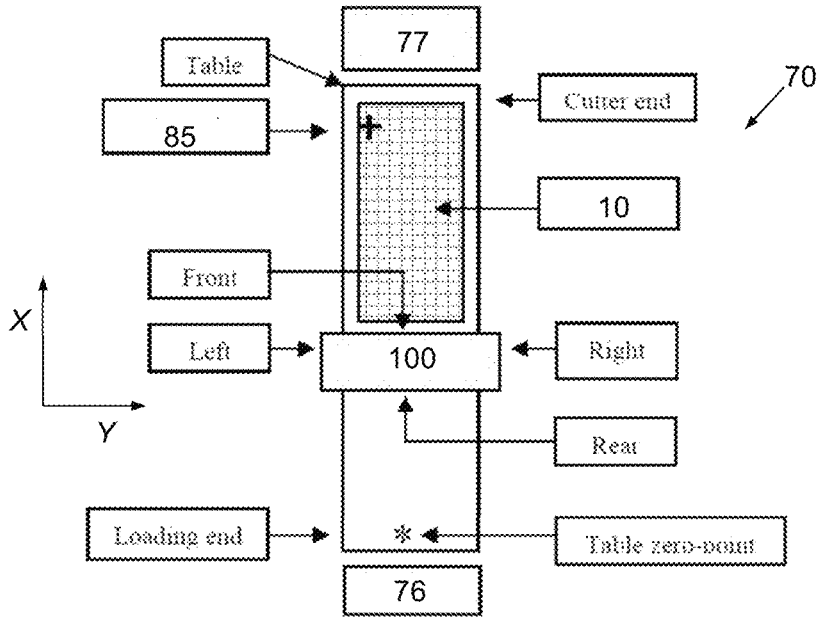
FIG. 8 is a graphic depiction of components of the material spreading machine of FIG. 6 and FIG. 7.

Referring to FIG. 8, the workstation 71 of FIG. 7 is shown in another schematic view. In this example, terms descriptive of orientation of the spreader 71 are included. A spread 85 is shown and includes sheet material 10 that has been spread on the table 75 by the spreader 100. More detail on the workstation 71 and the spreader 100 are shown in FIG. 9.

Figure 9:
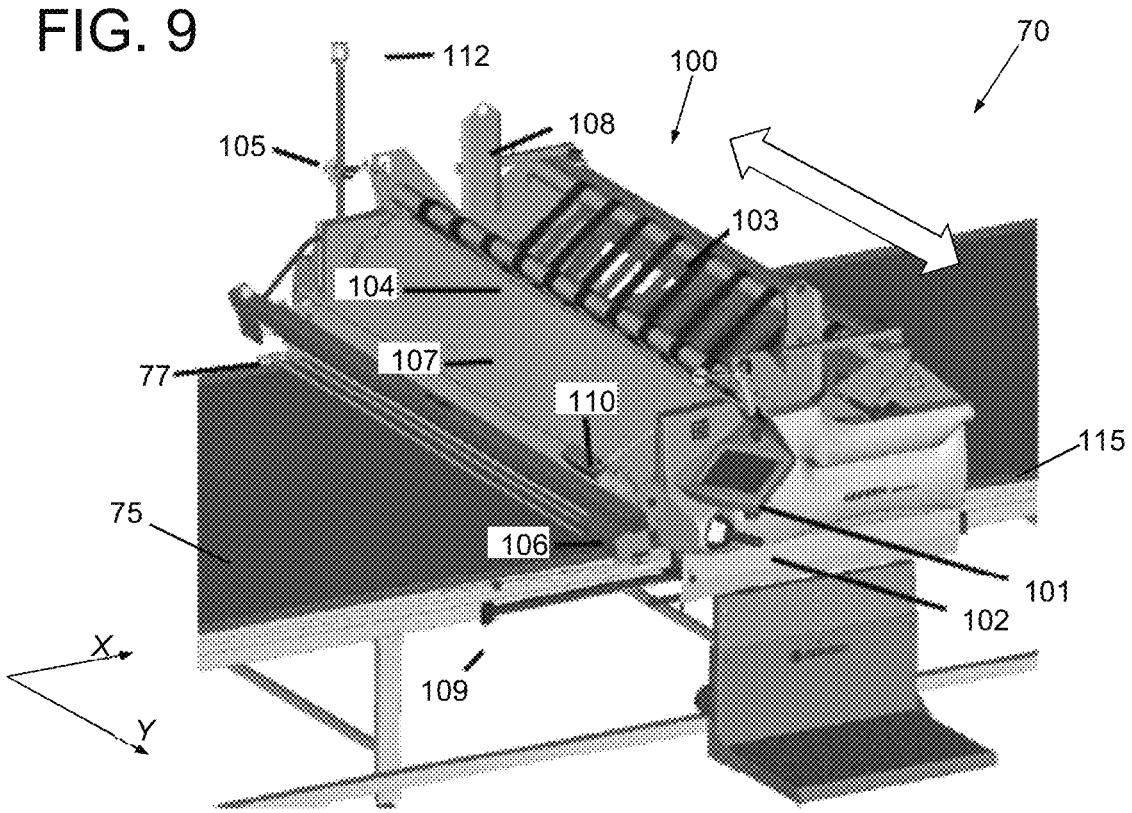
FIG. 9 is a perspective view of the material spreading machine of FIG. 6, FIG. 7 and FIG. 8.

FIG. 9 presents a graphic depiction of the spreader 100. In this non-limiting example, the spreader 100 is disposed over table 75 and includes various sub-components. For example, the spreader 100 includes operator panel 101. In this example, the spreader 100 is operated partly from the operator panel 101, partly from a speed throttle 102. The operator panel 101 and the speed throttle 102 communicate with the controller 80, which is in control of at least some of the sub-components of the spreader 100. The operator panel 101 includes a touch screen interface. The speed throttle 102 is used for operating the spreader 100 manually. When turning the speed throttle 102, the spreader 100 will start in the desired direction (i.e., the X-direction). The more the speed throttle 102 is turned, the faster the speed of the sheet material 10 through the spreader 100. Included is a cradle 103. A roll of the sheet material 10 may be loaded into the cradle 103 for spreading. Also included is a dancer bar 104. The dancer bar 104 controls tension of the sheet material 10. The spreader 100 may be operated with or without the dancer bar 104. Counterweights 105 may be included for adjusting the dancer bar 104. Elevator 106 may be included to position equipment as low as possible, but above the top ply of the sheet material 10. A guide plate 107 may be included to guides the sheet material 10 to the spreading table 75. A material roll guide 108 may be included to keep the roll of sheet material 10 in a desired position. An obstacle sensor 109 may be included. In this example, the obstacle sensor 109 is disposed in the operator side of the spreader 100 and table 75. The obstacle sensor 109 will sense anything is in the way of the spreader 100 during operation. The obstacle sensor 109 may be adjustable lengthwise (in the X-direction). Also included is edge sensor 110. Generally, the edge sensor 110 registers the actual edge 56 of the sheet material 20 and is useful for aligning the actual edge 56 of the sheet material 10. The spreader 100 may also include therewith the cutter 77. The cutter 77 cuts the sheet material 10 at the end of each ply. A grinding house (not shown) on the cutter 77 may be included for sharpening the cutter 77. A warning light 112 may be included to indicate that the drive motor is active or for other signaling.

Commercially available examples of the spreader 100 include the XLs GERBERSpreaders™ available from Gerber Technology of Tolland Conn., USA. Aspects of these spreaders 100 are disclosed in greater detail in the "Getting Started Manual" printed in 2006. This manual and any accompanying documents are incorporated by reference herein in their entirety for any purpose whatsoever.

Traditionally, in the prior art, when sheet material 10 is spread with an automatic spreading machine 100, the sheet material 10 is automatically aligned in the direction of the spread (as depicted, this is the X-direction) by an actuator acting in response to edge sensor 110 that locates the actual edge 56 of the sheet material 10. Typically, edge detection is accomplished using two reflective sensors (not shown) and illumination (not shown) mounted within the edge sensor 110. The two reflective sensors detect reflections from a reflector 115. In this example, the reflector 115 is disposed along a length, L, of the table 75. As the sheet material 10 is fed from a roll, the spreader 100 moves the roll in the cradle 103, from side to side (as depicted, this is the Y-direction) to keep the inner reflective sensor blocked (so the inner sensor cannot see the reflection) and the outer sensor reflecting (nothing is interfering with the reflection). If the inner sensor sees a reflection the cradle 103 moves the material toward the outer sensor. If the outer sensor is blocked, the cradle 103 moves the material toward the inner sensor.

Typical reflective sensors suffer from a variety of problems. These include poor sensitivity and a general inability to adapt to changing appearance of the sheet material 10, or subtle differences therein. While a reflective sensor is good at sensing an edge having good physical integrity, the reflective sensor will not identify a poor or frayed edge and cannot discern a feature within the material from the edge.

In embodiments disclosed herein, an improved edge sensor 210 includes a pair of color sensing devices. With the pair of color sensing devices, greatly improved detection of the useable edge 55 of the sheet material 10 is realized. Further, by making use of color sensor devices as disclosed herein, the controller 80 may be trained to signal the presence of or lack of a particular feature such as the useable edge 55 of the sheet material 10 or the top layer edge in a laminate of the material. Color detection capabilities may be augmented with backlighting of the sheet material 10 (such as lighting provided from the surface of the table 75). Using color detection in combination with backlighting permits measurement of light attenuation. With light attenuation data, the controller 80 may calculate aspects such as material thickness, thickness variability and may further be used for detection of patterns or other features. This technique may also be employed with or instead of surface lighting. Surface lighting may be advantageous for improved feature detection. The benefits of variable color surface lighting could also be achieved using a sensor that supported RGB detection values. Color detection sensing has the added benefit of providing for recognition of color shifts within a given roll of sheet material 10 and between rolls of sheet material 10. The controller 80 may be configured to alert a machine operator of a potential issue with color shifts outside of acceptable parameters with deviation from a desired tolerance. Other features such as reflectivity, contrast or energy absorption may be ascertained using color sensors and/or other sensors as deemed appropriate. In some embodiments, techniques may be used to identify alignment features within the surface of the sheet material 10. Sensing of energy absorption or material density changes have the added benefit of providing for identification of the outer edge 56 of the underlying material edge (vs a partial or incomplete stack of layers 30) but can identify the usable edge 55 of the sheet material 10.

This method of material alignment based on the usable edge 55 of a given sheet material 10 is useful for single ply feeding onto a cutter 77 as well as alignment of multiple material layers for multiple ply spreading for use on a multi-ply cutter 77. In addition, alignment for determination of a usable edge 55 versus the outer edge 56 is useful in manufacture of many different materials for rolling and subsequent processing.

Figure 10:
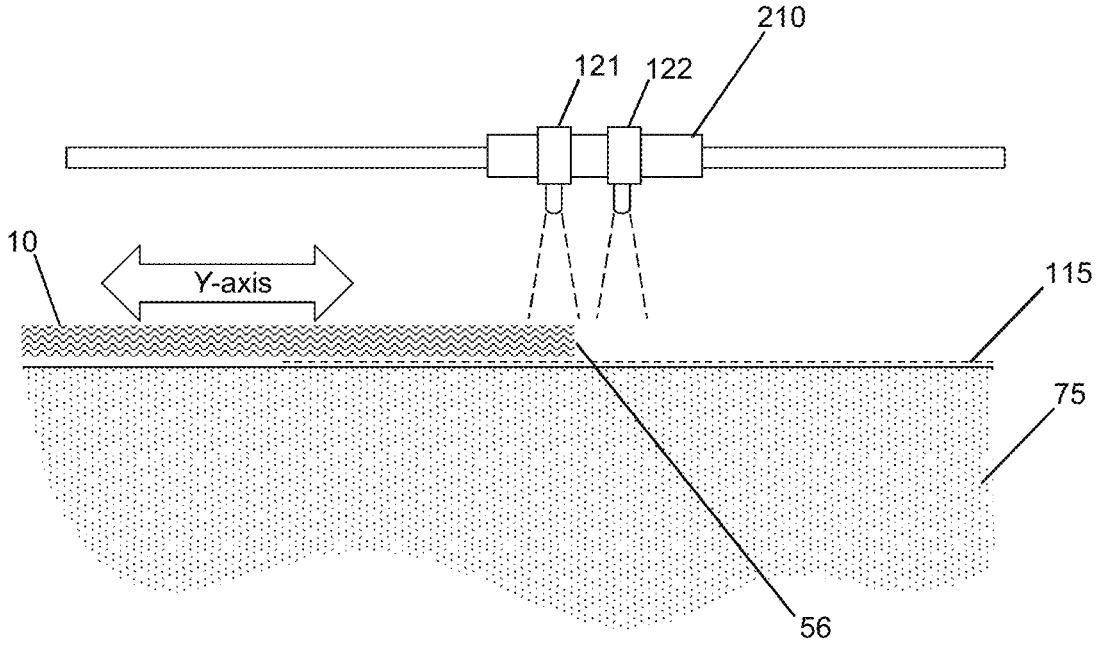
FIG. 10 is cross-sectional diagram of a portion of the spreading machine of FIG. 6, FIG. 7, FIG. 8 and FIG. 9; and, FIG. 11A, FIG. 11B and FIG. 11C, collectively referred to herein as FIG. 11, are depictions of configurations for a sensor.

Aspects of a configuration for edge detection are better shown in FIG. 10.

As shown in FIG. 10, an exemplary embodiment of the edge sensor 210 is shown. In this first embodiment, the edge sensor 210 includes a first sensor 121 and a second sensor 122. Generally, configuring the edge sensor 210 with the first sensor 121 and the second sensor 122 as described herein dispenses with a need for the reflector 115. In some embodiments, the edge sensor 210 with the first sensor 121 and the second sensor 122 as described herein is provided as a retrofit to an existing system 70, and the reflector 115 may be left in place.

Generally, components used as either one or both of the first sensor 121 and the second sensor 122 are sophisticated devices capable of rapid and reliable sensing. The components generally include an imaging sensor, such as a CMOS or CCD sensor. Included are lighting elements, such as an array of LEDs that emit varying wavelengths. Other subcomponents include memory, a processor, a communications channel, a power supply, optical elements and a housing along with local user controls. The edge sensor 210 may include additional components such as memory, a processor, a communications channel, and a power supply. In some embodiments, the edge sensor 210 communicates with the first sensor 121 and the second sensor 122 and provides data to the controller 80.

As controller 80 receives appropriate signaling from the edge sensor 210, or directly from the first sensor 121 and the second sensor 122, the controller 80 will control operation of the spreader 100. That is, the controller 80 will cause a drive for the spreader 100 to shift dispensing of the sheet material 10 laterally (in the Y-direction) in order to align layers of the sheet material 10. When the edge sensor 210 detects proper orientation of the usable edge, the shifting will cease and the dispensing will continue. Operation of the spreader 100 in this manner will cause alignment of the usable edge 55 between layers of sheet material 10, thus causing a stack of layers 30 that includes aligned usable edges 55.

Having introduced aspects of the spreader 100, some additional features are now set forth.

An example of a color sensor suited for use in the edge sensor 210 includes the LR-W Series Self Contained Full-Spectrum color sensors from Keyence Corporation of Itasca, Ill. The unique technology in the LR-W series allows it to analyze the full light spectrum. This series can detect everything from surface finish differences to color changes that are hard to see with the naked eye. Unlike conventional sensors which only use a red LED, the LR-W utilizes a white LED and the full color spectrum. By doing this, the LR-W can reliably and stably differentiate a much wider range of targets. By using an auto tuning function, the LR-W accounts for a target's color, brightness, and surface finish to determine which detection method is best suited for the given application. This helps to ensure stable detection regardless of target variations. Color inconsistencies, vibration, worn surfaces, or angled/tilted targets can all lead to unstable detection. Master calibration allows a user to teach variations to the sensor in advance. Furthermore, a master addition calibration sequence enables users to easily add conditions as they arise.

Another example of a color sensor suited for use in the edge sensor 210 includes the QC50 Series True Color Sensor available from Banner Engineering, Inc. of Minneapolis, Minn. Further examples of color sensors suited for use in the edge sensor 210 include the LX-100 Series digital mark sensor as well as the FZ-10 Series Color Detection Fiber Sensor, both of which are available from SUNX Limited of Japan.

Each of the foregoing sensors are described in detail in documentation provided by the respective manufacturer. The documentation is incorporated by reference herein for any use whatsoever.

Although embodiments of the first sensor 121 and the second sensor 122 are set forth as "color" sensors, sensing may occur in any wavelength deemed appropriate. For example, sensing may take place using at least one of wavelengths commonly referred to as UV, N-UV, VIS, N-IR and IR.

Color detection capabilities may be augmented with the use of backlighting the sheet material 10, using for example, illumination from under a transparent or translucent table 75. This may take advantage of light attenuation, colored surface lighting or other such lighting and also improve feature detection. Variable color surface lighting may be used with a sensor that supported RGB detection values, as well as with color filter(s). Color detection sensing has the added benefit of recognizing color shifts within a given roll of material and from one roll to another and can be used to alert a machine operator of a potential issue with color shifts outside of acceptable parameters with deviation from the norm. In this example, the feature of color was used but similarly other sensors such as reflectivity, contrast or energy absorption techniques could be used to identify alignment features within the surface of the material being spread. Sensing energy absorption or material density changes have the added benefit of identifying not only the edge of the underlying material edge (versus a partial or incomplete material stack) but can identify the useable edge of the material. Most materials will have a selvage edge which has an incomplete weave and is therefore not useable in a finished product. The selvage area has a density lower than the primary useable area and it would be beneficial to guide the material spread according to the primary edge and not the selvage or incomplete material stack. The feedback from the pair of sensors would be used in the same way as the existing reflective sensors, but the feedback would now be based on more information than the presence of lack of presence of material.

Figure 11A:
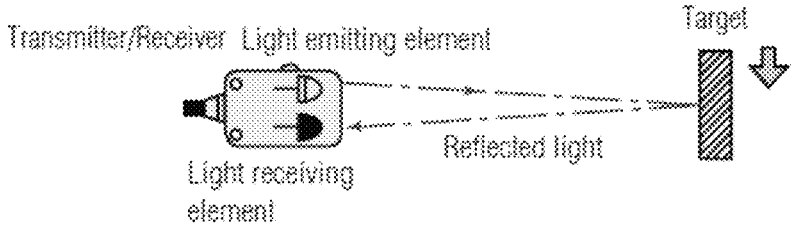
Figure 11B:
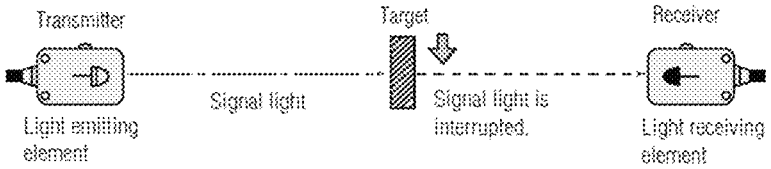
Figure 11C:
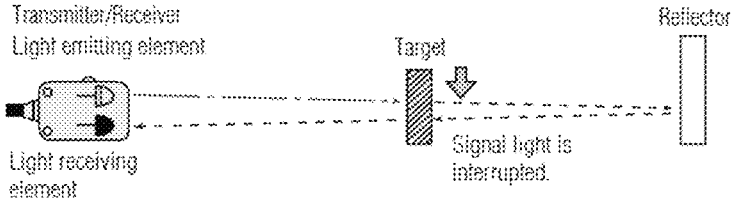

Generally, the first sensor 121 and the second sensor 122 are configured to take advantage of reflected light (See FIG. 11A). In some embodiments, at least one of the first sensor 121 and the second sensor 122 are configured with a light source on an opposing side of the sheet material 10 (See FIG. 11B). In some embodiments, at least one of the first sensor 121 and the second sensor 122 are configured with a reflector on an opposing side of the sheet material 10 (See FIG. 11C). Accordingly, various configurations of the edge sensor 210 may be had.

The edge sensor 210 including the first sensor 121 and the second sensor 122 along with appropriate software and other components may be provided as a kit for retrofit of a prior art spreader 100.

Method of material alignment based on the useable edge of a given material is useful for single ply feeding onto a cutter as well as alignment of multiple material layers for multiple ply spreading for use on a multiple ply cutter. In addition, alignment for determination of a useable edge versus a physical edge of material is useful in manufacture of many different materials for rolling and subsequent processing.

Further to the method for useable edge detection, sensing density or color over the traditional "break the beam" edge sensing provides the opportunity to add a level of machine control allowing for control based on min/max variability and tolerance on useable edge sensed feedback.

With capabilities of detecting substantially more information than simply the presence or absence of material, a variety of techniques may be employed. For example, the controller 80 may use color (or density or other detectable data about the material) to ascertain the quality of the match and calibrate the both sensors in a single training operation. Specifically, and as an example, one sensor may be trained for the presence of a color while the other sensor may be trained to detect the absence of the same color.

The edge sensor 210 provides for edge detection in non-standard or difficult to detect situations. Advantageously, in some embodiments, the edge sensor 210 may be used to scan the entire width of sheet material 10. These embodiments may be useful in determining change within the roll that could trigger an error if beyond pre-determined limits for things like color changes, thickness changes, density changes.

In some embodiments, the edge sensor 210 may be used on the cutter 77 to detect material alignment with the cutter 77. An edge sensor 210 mounted on the cutter 77 may be used to communicate with the controller 80 and control operations thereof. For example, the edge sensor 210 mounted on the cutter 77 may be used to skew the cut file according to the sensed usable edge 55. In some further embodiments, a first edge sensor 210 may be used with the dancer bar 104, while a second edge sensor 210 is used with the cutter 77. Among other things, these embodiments may ensure angular alignment of the sheet material 10 in general in addition to during the cutting process.

The edge sensor 210 may include a variety of other sensors as deemed appropriate, some of which are mentioned above. Additional sensors may include, for example, a time-of-flight sensor. The time-of-flight sensor is a range imaging sensor system that resolves distance based on the known speed of light, measuring the time-of-flight of a light signal between the sensor and the subject for each point of the image. The time-of-flight sensor is a class of scanner-less LIDAR, in which the entire scene is captured with each laser or light pulse, as opposed to point-by-point with a laser beam such as in scanning LIDAR systems. The time-of-flight sensor may be used, for example, to measure material thickness and thickness changes.

Generally, the controller 80 for controlling operation of the spreader 100 has one or more central processing units (processors). Processors are coupled to random access memory (RAM) (also referred to "system memory," or simply as "memory") and various other components via a system bus. The controller may include read only memory (ROM) coupled to the system bus. The ROM may include a built-in operating system (BIOS), which controls certain basic functions of computer.

The controller may include an input/output (I/O) adapter and a communications adapter coupled to the system bus. The I/O adapter generally provides for communicating with a hard disk and/or long term storage unit (such as a tape drive, a solid state drive (SSD)) or any other similar component (such as an optical drive).

The communications adapter interconnects system bus with an outside network enabling controller to communicate with other such systems. The communications adapter may be supportive of at least of one of wired and wireless communication protocols, and may communicate (directly or indirectly) with the Internet.

In some embodiments, there are two network adapters. A first network adapter connects to a customer network, and/or the Internet. The second network adapter connects to a bridge device that communicates to the edge sensor 210.

The controller is powered by a suitable power supply. Input/output devices are provided via user interface (UI) adapter. A keyboard, a pointing device (e.g., a mouse), and speaker may be included and interconnected to controller via user interface adapter. Other user interface components may be included as deemed appropriate.

Generally, the controller stores machine readable instructions on non-transitory machine readable media (such as in ROM, RAM, or in a mass storage unit). The machine readable instructions (which may be referred to herein as "software," as an "application," as a "client, a "process," a "plug-in" and by other similar terms) generally provide for functionality as will be discussed in detail further herein.

Some of the machine readable instructions stored on non-transitory machine readable media may include an operating environment. For example, and as presented herein, a suitable operating environment is WINDOWS (available from Microsoft Corporation of Redmond Wash.). Software as provided herein may be developed in, for example, SQL language, which is a cross-vendor query language for managing relational databases. Aspects of the software may be implemented with other software. For example, user interfaces may be provided in XML, HTML and the like.

It should be recognized that some control functionality as may be described herein may be implemented by hardware (such as by drive), or by software, as appropriate. Accordingly, where reference is made to implementation in one manner or another, such implementation is merely illustrative and is not limiting of techniques described. Operation of the controller may be combined with or enhanced by other technology such as machine vision, use of neural networks and through other such techniques.

A technical effect of the teachings herein is that the system allows for fully automated material feeding and spreading. This increases accuracy of material loading and spreading, eliminates the need for a secondary alignment process (labor cost), increases potential material utilization by eliminating buffering at the cutter starting point and reduces the time expended in the preparation of the material.

The following reference numbers are used herein. While the reference numbers are used with generally used with the associated terminology, in some instances, similar terminology may be used the reference numbers.

10 sheet material
30 stack of layers
41 excess material; strip of excess material; or selvage
42 usable width
51 first layer
52 second layer
55 usable edge
56 outer edge
70 system
100 spreader
71 workstation
76 loader
77 cutter
75 table
80 controller
101 operator panel
102 speed throttle
103 cradle
104 dancer bar
105 counterweights
106 elevator
107 guide plate
108 material roll guide
109 obstacle sensor
110 edge sensor
112 warning light
115 reflector
210 edge sensor
121 first sensor
122 second sensor Various other components may be included and called upon for providing for aspects of the teachings herein. For example, additional materials, combinations of materials and/or omission of materials may be used to provide for added embodiments that are within the scope of the teachings herein.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for determining sheet material edges on a surface, comprising:

a sensor located adjacent to the sheet material and configured to detect an outer edge and a usable edge of the sheet material; and a controller in communication with the sensor;

wherein the sensor comprises:

a first color optical sensor producing a first signal representing the usable edge; and a second color optical sensor producing a second signal representing the outer edge;

wherein the controller comprises a processor, a memory, and a communications adapter;

wherein the controller controls dispensing and spreading of the sheet material for detection by the sensor; and wherein the controller signals to a user a presence of the usable edge in the sheet material upon detection by the sensor.

2. The apparatus of claim 1, further comprising an operator panel in communication with the controller.

3. The apparatus of claim 2, wherein the operator panel comprises a touch screen interface.

4. The apparatus of claim 1, further comprising backlighting of the sheet material, said first and second color optical sensors and said backlighting together permitting measurement of light attenuation.

5. The apparatus of claim 3, wherein the controller determines one or more of material thickness, thickness variability, and pattern detection.

6. The apparatus of claim 1, wherein said first color optical sensor and said second color optical sensor recognize color shifts within the sheet material.

7. The apparatus of claim 6, wherein, upon recognition of said color shifts within the sheet material, said controller alerts a machine operator of a potential issue with said color shifts outside of acceptable parameters of a desired tolerance.

8. The apparatus of claim 1, further comprising a cutter in communication with said first and second color sensors and said controller and configured for cutting the sheet material along the usable edge.

9. The apparatus of claim 1, further comprising an obstacle sensor sensing impediments in the way of the sheet material upon dispensing and spreading.

10. The apparatus of claim 1, further comprising a reflector on an opposing side of said sheet material from said first and second color optical sensors.

11. The apparatus of claim 1, further comprising a light source on an opposing side of said sheet material from said first and second color optical sensors.

12. The apparatus of claim 1, wherein the first and second color optical sensors further communicate instructions for aligning the usable edge of the sheet material to said controller.

13. A method of determining sheet material edges on a surface, comprising the steps of:

detecting, by a sensor located adjacent to the sheet material, an outer edge and a usable edge of the sheet material;

controlling, by a controller comprising a processor, a memory, and a communications adapter in communication with the sensor, dispensing and spreading of the sheet material for detection by the sensor; and signaling, by the controller to a user, a presence of the usable edge in the sheet material upon detection by the sensor;

wherein the sensor comprises:

a first color optical sensor producing a first signal representing the usable edge; and a second color optical sensor producing a second signal representing the outer edge.

14. The method of claim 13, wherein the controller comprises the steps of:

initiating dispensing of a first layer of said sheet material;

ceasing dispensing of said first layer upon detection by said first and second color optical sensors of a proper orientation of the usable edge on the first layer of sheet material;

initiating dispensing of at least a second layer of the sheet material; and aligning the usable edge of the first layer with a usable edge of at least the second layer.

15. The method of claim 13, further comprising the step of cutting, by a cutter in communication with said first and second color optical sensors and said controller, the sheet material along with usable edge.

16. The method of claim 13, further comprising the step of recognizing, by the first color optical sensor and said second color optical sensor, color shifts within the sheet material.

17. The method of claim 16, further comprising the step of alerting, by the controller to a user upon recognition of said color shifts within the sheet material, a potential issue with said color shifts outside of acceptable parameters of a desired tolerance.

* * * * *